US009079447B2

(12) United States Patent
Herlambang et al.

(10) Patent No.: US 9,079,447 B2
(45) Date of Patent: Jul. 14, 2015

(54) RECORDING MEDIUM

(71) Applicant: CANON KABUSHIKI KAISHA, Tokyo (JP)

(72) Inventors: Olivia Herlambang, Kawasaki (JP); Naoya Hatta, Kawasaki (JP); Ryo Taguri, Sagamihara (JP); Hisao Kamo, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/517,712

(22) Filed: Oct. 17, 2014

(65) Prior Publication Data

US 2015/0110978 A1 Apr. 23, 2015

(30) Foreign Application Priority Data

Oct. 23, 2013 (JP) ..... 2013-220412

(51) Int. Cl.

| | |
|---|---|
| ***B41M 5/00*** | (2006.01) |
| ***B41M 5/50*** | (2006.01) |
| ***B41M 5/52*** | (2006.01) |

(52) U.S. Cl.

CPC ..... *B41M 5/504* (2013.01); *B41M 5/506* (2013.01); *B41M 5/508* (2013.01); *B41M 5/5218* (2013.01); *B41M 2205/42* (2013.01)

(58) Field of Classification Search

CPC ..... B41M 5/504; B41M 5/506; B41M 5/508; B41M 5/5218

USPC ..... 428/32.22, 32.24

See application file for complete search history.

(56) References Cited

U.S. PATENT DOCUMENTS

| | | | | |
|---|---|---|---|---|
| 7,563,494 | B2 | 7/2009 | Nagashima | |
| 2002/0182380 | A1* | 12/2002 | Nagashima et al. | 428/195 |
| 2003/0072925 | A1* | 4/2003 | Kiyama et al. | 428/195 |

FOREIGN PATENT DOCUMENTS

| | | | |
|---|---|---|---|
| EP | 0524635 | A1 | 1/1993 |
| JP | H05221115 | A | 8/1993 |
| JP | 2000198268 | A | 7/2000 |
| JP | 2006327065 | A | 12/2006 |
| JP | 2007125816 | A | 5/2007 |

* cited by examiner

*Primary Examiner* — Betelhem Shewareged

(74) *Attorney, Agent, or Firm* — Canon U.S.A. Inc., IP Division

(57) ABSTRACT

A recording medium has a backcoat layer, a substrate, and an ink-receiving layer in this order. The backcoat layer contains a first inorganic particle, a second inorganic particle, and a binder. The first inorganic particle has an average aspect ratio of 5 or more and an average diameter of 0.2 μm or more and 10.0 μm or less. The second inorganic particle has an average aspect ratio of less than 5 and an average diameter of 0.1 μm or more and 0.9 μm or less. The mass ratio of the first inorganic particle content to the second inorganic particle content of the backcoat layer is 30/70 or more and 70/30 or less.

6 Claims, No Drawings

RECORDING MEDIUM

BACKGROUND OF THE INVENTION

1. Field of the Invention

The present invention relates to a recording medium.

2. Description of the Related Art

A recording medium with a recorded image may be stored for a long period of time in an album with its back (the side opposite the recorded image) attached to an adhesive page. Such a recording medium, which may be released and then attached once again, may be required to be easy to release from an adhesive surface of an album, or to have "album releasability."

During image recording, furthermore, a recording medium may be loaded in an image recording device in the form of a stack of multiple pieces. Each piece of the recording medium may be damaged by friction with the next pieces while being conveyed (hereinafter also referred to as "damage on conveyance").

These technical problems may be improved by the use of a method in which the back of a recording medium is modified. The following patent publications are some of known methods that include modifying the back of a recording medium.

Japanese Patent Laid-Open No. 2000-198268 describes a recording medium having on its back a layer containing an inorganic particle selected from kaolin, talc, calcium carbonate, and amorphous silica. Japanese Patent Laid-Open No. 5-221115 describes a recording medium having on its back a layer containing a tabular inorganic particle and an adhesive agent, the inorganic particle having an aspect ratio of 5 or more and 90 or less. Japanese Patent Laid-Open No. 2007-125816 describes a recording medium having on its back a layer containing an inorganic particle selected from clay, kaolin, talc, and calcium carbonate. Japanese Patent Laid-Open No. 2006-327065 discloses a recording medium containing talc in its back and having a particular friction coefficient.

SUMMARY OF THE INVENTION

A recording medium according to an aspect of the invention has a backcoat layer, a substrate, and an ink-receiving layer in this order. The backcoat layer contains a first inorganic particle, a second inorganic particle, and a binder. The first inorganic particle has an average aspect ratio (average diameter/average thickness) of 5 or more and an average diameter of 0.2 μm or more and 10.0 μm or less. The second inorganic particle has an average aspect ratio (average diameter/average thickness) of less than 5 and an average diameter of 0.1 μm or more and 0.9 μm or less. The mass ratio of the first inorganic particle content to the second inorganic particle content of the backcoat layer is 30/70 or more and 70/30 or less.

A recording medium according to another aspect of the invention has a backcoat layer, a substrate, and an ink-receiving layer in this order. The backcoat layer contains a first inorganic particle having an average diameter of 0.2 μm or more and 10.0 μm or less, a second inorganic particle having an average particle diameter of 0.1 μm or more and 0.9 μm or less, and a binder. The first inorganic particle includes at least one selected from tabular kaolin, tabular calcium carbonate, tabular mica, and tabular talc. The second inorganic particle includes at least one selected from elongated calcium carbonate and titanium oxide. The mass ratio of the first inorganic particle content to the second inorganic particle content of the backcoat layer is 30/70 or more and 70/30 or less.

Further features of the present invention will become apparent from the following description of exemplary embodiments.

DESCRIPTION OF THE EMBODIMENTS

The inventors found through research that the recording media described in the above patent publications are unsatisfactory in terms of album releasability and protection against damage on conveyance.

Certain aspects of the invention may therefore provide a recording medium that is excellent in terms of album releasability and protection against damage on conveyance.

The following describes some aspects of the invention in detail by referring to preferred embodiments.

Recording Medium

A recording medium according to an embodiment of the invention has a backcoat layer, a substrate, and an ink-receiving layer. In an embodiment of the invention, the recording medium can be a recording medium for ink jet recording, i.e., an ink jet recording medium.

Substrate

Examples of substrates include substrates composed solely of a base paper and substrates having a base paper and a resin layer, i.e., substrates composed of a base paper coated with resin. In an embodiment of the invention, the substrate can be one composed solely of a base paper.

A base paper is made from wood pulp as the main ingredient, optionally containing synthetic pulp, such as polypropylene, and/or synthetic fiber, such as nylon or polyester. Examples of wood pulps include leaf bleached kraft pulp (LBKP), leaf bleached sulfite pulp (LBSP), needle bleached kraft pulp (NBKP), needle bleached sulfite pulp (NBSP), leaf dissolving pulp (LDP), needle dissolving pulp (NDP), lead unbleached kraft pulp (LUKP), and needle unbleached kraft pulp (NUKP). A single pulp can be used alone, and it is also possible to use two or more pulps if necessary. Among wood pulps, LBKP, NBSP, LBSP, NDP, and LDP are preferred because of their high short-fiber content. High-purity chemical pulps (e.g., sulfate pulps and sulfite pulps) and pulps bleached for improved whiteness can also be used. A base paper may optionally contain additives such as sizing agents, white pigments, paper-reinforcing agents, fluorescent brightening agents, moisture-retaining agents, dispersants, and softeners.

In an embodiment of the invention, the thickness of a base paper may be 50 μm or more and 200 μm or less, such as 90 μm or more and 180 μm or less. In an embodiment of the invention, the following method can be used to calculate the thickness of a base paper. First, a cross-section of the recording medium of interest cut with a microtome is observed under a scanning electron microscope. Then its thickness is measured at 100 or more points. The mean of the measurements can be used as the thickness of the base paper. The thickness of other layers in certain embodiments of the invention can also be measured using the same method.

In an embodiment of the invention, the density of a base paper as measured in accordance with JIS P 8118 may be 0.6 $g/cm^3$ or more and 1.2 $g/cm^3$ or less, such as 0.7 $g/cm^3$ or more and 1.2 $g/cm^3$ or less.

Backcoat Layer

In an embodiment of the invention, the recording medium has a backcoat layer on the side of the substrate opposite the side where the ink-receiving layer is located. The backcoat layer contains a first inorganic particle, a second inorganic particle, and a binder. In an embodiment of the invention, the thickness of the backcoat layer may be 5 μm or more and 40 μm or less, such as 10 μm or more and 30 μm or less.

Several methods can be used to form the backcoat layer. A possible method includes preparing a coating liquid for the formation of the backcoat layer, applying the coating liquid to the substrate, and then drying the applied liquid. Examples of coating techniques that can be used to apply a coating liquid to the substrate include a curtain coater, an extrusion coater, and a slide-hopper-based coater. It is also possible to immerse the substrate in the coating liquid. Examples of techniques that can be used to dry an applied coating liquid include techniques that involve the use of a hot-air dryer, such as a linear tunnel oven, an arch dryer, an air-loop dryer, or a sine-curve air-float dryer, and techniques that involve the use of a different kind of dryer, such as an infrared oven, a heating dryer, or a microwave oven.

Inorganic Particles (1) First Inorganic Particle in an embodiment of the invention, the first inorganic particle has an average aspect ratio (average diameter/average thickness) of 5 or more and an average diameter of 0.2 μm or more and 10.0 μm or less. The average aspect ratio can be determined using the method described in Japanese Patent Publication No. 5-16015. The average aspect ratio is expressed as the ratio of the "average diameter" to the "average thickness" of the particle. The term "average diameter" is the diameter of a circle having an area equal to the projected area of the inorganic particle as viewed under a photomicroscope or an electron microscope. In certain embodiments of the invention, an average aspect of 5 or more means that the inorganic particle is tabular. In an embodiment of the invention, the average aspect ratio of the first inorganic particle may be 90 or less.

Examples of inorganic particles having the average aspect ratio of 5 or more include tabular kaolin, tabular calcium carbonate, tabular mica, and tabular talc. The first inorganic particle can therefore include at least one selected from tabular kaolin, tabular calcium carbonate, tabular mica, and tabular talc.

(2) Second Inorganic Particle

In an embodiment of the invention, the second inorganic particle has an average aspect ratio (average diameter/average thickness) of less than 5 and an average diameter of 0.1 μm or more and 0.9 μm or less. In certain embodiments of the invention, an average aspect of less than 5 means that the inorganic particle is not tabular.

Examples of inorganic particles that meet this average aspect ratio condition include elongated calcium carbonate and titanium oxide. The second inorganic particle can therefore include at least one selected from elongated calcium carbonate and titanium oxide.

(3) Mass Ratio Between the First and Second Inorganic Particles

In an embodiment of the invention, the mass ratio of the first inorganic particle content to the second inorganic particle content of the backcoat layer is 30/70 or more and 70/30 or less.

In certain embodiments of the invention, the use of a tabular inorganic particle, such as the first inorganic particle, in the backcoat layer makes the surface of the backcoat layer (the side opposite the substrate side) smooth. When multiple pieces of the recording medium are stacked, this smoothness reduces the friction between adjacent pieces of the recording medium and thereby provides protection against damage on conveyance. However, using a tabular inorganic particle, such as the first inorganic particle, alone in the backcoat layer would make the area where the recording medium makes contact with an adhesive agent used in an album so large that the album releasability of the recording medium would be low. As a solution to this, a non-tabular inorganic particle, such as the second inorganic particle, is used in the backcoat layer in such a manner that the mass ratio between the tabular and non-tabular particles should be in the range specified above. This provides the recording medium with high album releasability without affecting its high protection against damage on conveyance.

The inventors also found through research that meeting the above mass ratio condition increases scattering of light in the backcoat layer and therefore enhances the opacity of the recording medium. The enhanced opacity prevents, for example, the background color or other surface features of a page of an album from being seen through the image surface.

Making this mass ratio less than 30/70 may lead to both the protection against damage on conveyance and the album releasability of the recording medium being insufficient. Making this mass ratio more than 70/30 may result in low album releasability of the recording medium.

Furthermore, album releasability may be low if the average diameter of the first inorganic particle is less than 0.2 μm or more than 10.0 μm. It may be impossible to achieve both high album releasability and high protection against damage on conveyance if the average diameter of the second inorganic particle is less than 0.1 μm or more than 0.9 μm.

Binder

In an embodiment of the invention, the backcoat layer contains a binder. In certain embodiments of the invention, the binder refers to a material that binds an inorganic particle together and allows it to form a coating.

In an embodiment of the invention, the binder content of the backcoat layer may be 50% by mass or less, such as 30% by mass or less, based on the total inorganic particle content. The binder content may be 6% by mass or more, such as 19% by mass or more, for improved binding of inorganic particles in the backcoat layer.

Examples of binders include the following: starch derivatives, such as oxidized starch, etherified starch, and phosphorylated starch; cellulose derivatives, such as carboxymethyl cellulose and hydroxyethyl cellulose; casein, gelatin, soy protein, polyvinyl alcohol (PVA), and their derivatives; latexes based on conjugated polymers such as polyvinylpyrrolidone, maleic anhydride resins, styrene-butadiene copolymers, and methyl methacrylate-butadiene copolymers; latexes based on acrylic polymers such as acrylate- or methacrylate-based polymers; latexes based on vinyl polymers such as ethylene-vinyl acetate copolymers; functionalized polymer latexes based on polymers of the foregoing types containing a monomer having functional groups such as carboxyl; polymers of the foregoing types cationized using a cationic group; polymers of the foregoing types having their surface cationized using a cationic surfactant; polymers of the foregoing types having PVA distributed on their surface, obtained through polymerization of the unit monomer in the presence of a cationic PVA; polymers of the foregoing types having cationic colloidal particles distributed on their surface, obtained through polymerization of the unit monomer in a suspension containing dispersed cationic colloidal particles; aqueous binders such as thermosetting synthetic resins, e.g., melamine resins and urea resins; acrylate- or methacrylate-based polymers and copolymers, such as polymethyl methacrylate; and synthetic resins such as polyurethane resins, unsaturated polyester resins, vinyl chloride-vinyl acetate copolymers, polyvinyl butyral, and alkyd resins. A single binder can be used alone, and it is also possible to use two or more binders if necessary.

Among such binders, PVA and PVA derivatives are preferred. Examples of PVA derivatives include cation-modified PVAs, anion-modified PVAs, silanol-modified PVAs, and polyvinyl acetal. A cation-modified PVA can be, for example, the PVA described in Japanese Patent Laid-Open No. 61-10483, i.e., a PVA containing any of primary to tertiary amino groups or quaternary ammonium in the main chain or a side chain.

An example of a way to synthesize PVA is to saponify polyvinyl acetate. The degree of saponification of PVA may be 80 mol % or more and 100 mol % or less, such as 85 mol % or more and 98 mol % or less. The degree of saponification is the ratio of the number of moles of hydroxyl groups resulting from the reaction for the saponification of polyvinyl acetate into the PVA and, in certain embodiments of the invention, represents a value measured using a method described in JIS K 6726. The average degree of polymerization of PVA may be 1,500 or more and 5,000 or less, such as 2,000 or more and 5,000 or less. In certain embodiments of the invention, the average degree of polymerization represents a viscosity-average degree of polymerization determined using a method described in JIS K 6726.

Other Additives

In certain embodiments of the invention, the backcoat layer may contain other additives, in addition to the components described above. Specific examples of such additives include crosslinking agents, pH adjusters, thickeners, fluidity modifiers, antifoams, foam reducers, surfactants, releasing agents, penetrants, coloring pigments, coloring dyes, fluorescent brightening agents, ultraviolet absorbers, antioxidants, preservatives, antimolds, water-resistant additives, dye fixatives, curing agents, and weather-resistant materials.

Ink-Receiving Layer

In an embodiment of the invention, the ink-receiving layer can be a single layer or have a multilayer structure containing two or more layers. The total thickness of the ink-receiving layer may be 10 μm or more and 60 μm or less, such as 15 μm or more and 30 μm or less.

In an embodiment of the invention, the ink-receiving layer can have a multilayer structure containing a first ink-receiving layer and a second ink-receiving layer, with the first ink-receiving layer being closer to the substrate than the second ink-receiving layer is. The first ink-receiving layer can contain fumed silica as an inorganic particle, and the second ink-receiving layer can contain alumina hydrate and fumed silica as inorganic particles. The first and second ink-receiving layers may also contain PVA as a binder and a boric acid compound as a crosslinking agent. The ratio of the alumina hydrate content to the fumed silica content of the second ink-receiving layer may be 70/30 or more, such as 90/10 or more.

The thickness of the first ink-receiving layer may be 10 μm or less, such as 3 μm or more and 10 μm or less. The thickness of the second ink-receiving layer may be 3 μm or more and 20 μm or less, such as 5 μm or more and 20 μm or less.

An example of a way to form the ink-receiving layer is to apply a coating liquid for the formation of the ink-receiving layer and then dry the applied liquid. In an embodiment of the invention, after forming an ink-receiving layer by applying a coating liquid for the formation of the ink-receiving layer and drying the applied liquid, coat the ink-receiving layer with a coating liquid containing a resin and a boric acid compound to make the ink-receiving layer moist and then press the moist ink-receiving layer with a mirror-surface roller. This method provides the recording medium with high gloss.

The following describes some materials that can be contained in the ink-receiving layer in an embodiment of the invention.

Inorganic Particle

Examples of inorganic particles that can be used in the ink-receiving layer according to an embodiment of the invention include alumina hydrate, fumed alumina, fumed silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. A single inorganic particle can be used alone, and it is also possible to use two or more inorganic particles if necessary. In particular, alumina hydrate, fumed alumina, and fumed silica can form a porous structure highly absorbent to ink. The following describes alumina hydrate, fused alumina, and fused silica in detail.

A form of alumina hydrate that can be used is represented by the following general formula (X):

$Al_2O_{3-n}(OH)_{2n}.mH_2O$ (where n is 0, 1, 2, or 3, and m is 0 or more and 10 or less, such as 0 or more and 5 or less, with at least one of m and n not being 0).

The term $mH_2O$ in many cases represents a releasable aqueous phase that does not participate in the formation of crystal lattices, and thus m is not necessarily an integer. Heating the alumina hydrate can make m zero.

In an embodiment of the invention, alumina hydrate may be in the form of a dispersion with a dispersant in a coating liquid. The average secondary particle diameter of dispersed alumina hydrate may be 100 nm or more and 300 nm or less, such as 100 nm or more and 200 nm or less. The average secondary particle diameter of dispersed alumina hydrate can be measured using dynamic light scattering.

In an embodiment of the invention, any known method can be used to produce alumina hydrate. Specific examples include hydrolysis of an aluminum alkoxide, hydrolysis of sodium aluminate, and neutralization of an aqueous solution of sodium aluminate with an aqueous solution of aluminum sulfate and aluminum chloride.

Alumina hydrate is known to have three different crystal structures depending on the temperature of heat treatment: amorphous, gibbsite, and boehmite. The crystal structure of alumina hydrate can be analyzed using X-ray diffractometry. In an embodiment of the invention, a boehmite or amorphous form of alumina hydrate is preferred. Specific examples include the alumina hydrates described in publications such as Japanese Patent Laid-Open Nos. 7-232473, 8-132731, 9-66664, and 9-76628 as well as commercially available alumina hydrates such as Disperal HP14 and HP18 (Sasol). A single alumina hydrate can be used alone, and it is also possible to use two or more alumina hydrates if necessary.

In an embodiment of the invention, the specific surface area of alumina hydrate as measured using the BET method may be 100 $m^2/g$ or more and 200 $m^2/g$ or less, such as 125 $m^2/g$ or more and 175 $m^2/g$ or less. The BET method is a method in which the specific surface area of a sample is determined from the quantity of a molecule or ion with a known size adsorbed on the surface of the sample. Examples of molecules and ions that are adsorbed on the sample include nitrogen gas.

Exemplary forms of fumed alumina include γ-alumina, α-alumina, δ-alumina, θ-alumina, and χ-alumina. In particular, the use of γ-alumina enhances the optical density of the image and improves ink absorbency. Specific examples of fumed alumina include AEROXIDE Alu C, AEROXIDE Alu 130, and AEROXIDE Alu 65 (EVONIK).

In an embodiment of the invention, the specific surface area of fumed alumina as measured using the BET method may be 50 $m^2/g$ or more, such as 80 $m^2/g$ or more, and even 150 $m^2/g$ or less, such as 120 $m^2/g$ or less.

The average primary particle diameter of fumed alumina may be 5 nm or more, such as 11 nm or more, and even 30 nm or less, such as 15 nm or less.

Alumina hydrate and fumed alumina used in certain embodiments of the invention can be in the form of an aqueous dispersion when mixed in a coating liquid for the formation of the ink-receiving layer. The dispersant used in such a case can be an acid. The use of a sulfonic acid, which is represented by the following general formula (Y), would prevent the ink from image bleeds:

$$R—SO_3H$$

(where R represents any of a hydrogen atom, an alkyl group containing 1 to 4 carbon atoms, and an alkenyl group containing 1 to 4 carbon atoms and may be substituted with an oxo group, a halogen atom, an alkoxy group, or an acyl group).

In an embodiment of the invention, the acid content may be 1.0% by mass or more and 2.0% by mass or less, such as 1.3% by mass or more and 1.6% by mass or less, based on the total content of alumina hydrate and fumed alumina.

The processes used to produce silica, a material that can be used in the ink-receiving layer, are roughly divided into wet processes and dry processes (gas-phase processes). A known example of a wet process is to prepare active silica through the acidolysis of a silicate and then polymerize the active silica to such an extent that it aggregates and precipitates to form water-containing silica. A known example of a dry process (a gas-phase process) is to obtain anhydrous silica through the high-temperature gas-phase hydrolysis of a silicon halide (flame hydrolysis) or through the thermal reduction and evaporation of silica sand and coke in an electric furnace using an arc followed by air-oxidation of the product (the arc method). In an embodiment of the invention, the use of a fumed silica obtained using a dry process (a gas-phase process) can significantly enhance ink absorbency because of the particularly large specific surface area of the fumed silica and can also provide the ink-receiving layer with transparency and thereby ensure good color development because of the low refractive index of the fumed silica. Specific examples of fumed silica include AEROSIL (Nippon Aerosil) and REOLOSIL QS (Tokuyama).

In an embodiment of the invention, the specific surface area of fumed silica as measured using the BET method may be 50 $m^2/g$ or more and 400 $m^2/g$ or less, such as 200 $m^2/g$ or more and 350 $m^2/g$ or less.

In an embodiment of the invention, fumed silica may be in the form of a dispersion with a dispersant in a coating liquid. The particle diameter of such dispersed fumed silica can be 100 nm or more and 200 nm or less. The particle diameter of dispersed fumed silica can be measured using dynamic light scattering.

Binder

In certain embodiments of the invention, the ink-receiving layer may contain a binder.

In an embodiment of the invention, the binder content of the ink-receiving layer may be 50% by mass or less, such as 30% by mass or less, based on the inorganic particle content so that good ink absorbency can be obtained. The binder content may be 5.0% by mass or more, such as 8.0% by mass or more, so that good binding of inorganic particles in the ink-receiving layer can be obtained.

Specific examples of binders are the same as described for the binder in the backcoat layer. PVA and PVA derivatives are still preferred for use as a binder in the ink-receiving layer. The degree of saponification of PVA in the ink-receiving layer may be 80 mol % or more and 100 mol % or less, such as 85 mol % or more and 98 mol % or less. The average degree of polymerization of PVA in the ink-receiving layer may be 1,500 or more and 5,000 or less, such as 2,000 or more and 5,000 or less.

Crosslinking Agent

In an embodiment of the invention, the ink-receiving layer may also contain a crosslinking agent. Examples of crosslinking agents include aldehyde compounds, melamine compounds, isocyanate compounds, zirconium compounds, amide compounds, aluminum compounds, boric acid compounds, and salts of boric acid compounds. A single crosslinking agent can be used alone, and it is also possible to use two or more crosslinking agents if necessary. The use of a boric acid compound and a salt of a boric acid compound as crosslinking agents is preferred, particularly when PVA or a PVA derivative is used as a binder.

Examples of boric acid compounds include orthoboric acid ($H_3BO_3$), metaboric acid, and hypoboric acid. Examples of salts of boric acid compounds include water-soluble salts of the exemplary boric acid compounds mentioned above, including the following: alkali metal salts of boric acid compounds, such as sodium orthoborate and potassium orthoborate; alkaline earth metal salts of boric acid compounds, such as magnesium orthoborate and calcium orthoborate; and ammonium salts of boric acid compounds. In particular, the use of orthoboric acid makes the coating liquid stable over time and is also effective in preventing cracks.

The amount of use of a crosslinking agent can be adjusted as appropriate in light of factors such as the conditions of production. In an embodiment of the invention, the crosslinking agent content of the ink-receiving layer may be 1.0% by mass or more and 50% by mass or less, such as 5% by mass or more and 40% by mass or less, based on the binder content.

When the ink-receiving layer contains PVA as a binder and at least one selected from boric acid compounds and salts of boric acid compounds as a crosslinking agent, the total content of boric acid compounds and salts of boric acid compounds in the ink-receiving layer can be 5% by mass or more and 30% by mass or less based on the PVA content.

Other Additives

In certain embodiments of the invention, the ink-receiving layer may contain other additives, in addition to the components described above. Specific examples of such additives include pH adjusters, thickeners, fluidity modifiers, antifoams, foam reducers, surfactants, releasing agents, penetrants, coloring pigments, coloring dyes, fluorescent brightening agents, ultraviolet absorbers, antioxidants, preservatives, antimolds, water-resistant additives, dye fixatives, curing agents, and weather-resistant materials.

Examples

The following describes certain aspects of the invention in more detail by providing examples and comparative examples. No aspect of the invention is limited to these examples while within the scope of the invention. The term "parts" in the following descriptions of examples is based on mass unless otherwise specified.

Preparation of Recording Media

Preparation of Substrates

Water was added to a mixture of 80 parts of an LBKP with a Canadian standard freeness of 450 mL CSF, 20 parts of an NBKP with a Canadian standard freeness of 480 mL CSF, 0.60 parts of cationized starch, 10 parts of heavy calcium carbonate, 15 parts of light calcium carbonate, 0.10 parts of an alkyl ketene dimer, and 0.030 parts of a cationic polyacrylamide to make the solid content 3.0% by mass, yielding a base stock. The base stock was processed into a sheet with a Fourdrinier paper machine, and the obtained sheet was subjected to a three-stage wet-pressing process and dried using a multiple-cylinder dryer. The dried sheet was impregnated with an aqueous solution of oxidized starch using a size press machine and then dried. The amount of the solution was such that the dry solid content would be 1.0 g/m$^2$. The dried sheet was then finished using a machine calender, yielding a substrate with a basis weight of 170 g/m$^2$, a Stockigt sizing degree of 100 seconds, an air permeance of 50 seconds, a Bekk smoothness of 30 seconds, a Gurley stiffness of 11.0 mN, and a thickness of 100

Then water was added to a mixture of 65 parts of kaolin ULTRAWHITE 90 (Engelhard), 10 parts of zinc oxide, 25 parts of aluminum hydroxide, and 0.1 parts of polyacrylic acid to form a slurry having a solid content of 70% by mass. This slurry was combined with 7 parts of styrene-butadiene latex and then with water to form a coating liquid having a solid content of 60% by mass. One side of the substrate (the surface on which an ink-receiving layer was to be formed) was then coated with this coating liquid for the formation of an undercoat layer using a blade coater and then dried. The amount of the liquid was such that the dry weight would be 10 g/m$^2$. The dried substrate was then finished using a machine calender, yielding a coated substrate with a basis weight of 185 g/m$^2$, a Stockigt sizing degree of 300 seconds, an air resistance of 3,000 seconds, a Bekk smoothness of 200 seconds, a Gurley stiffness of 11.5 mN, and an opacity of 90%.

Preparation of Coating Liquids for the Formation of a Backcoat Layer

The materials indicated in Table 1 were mixed. Each content value is a solid content. The binders and crosslinking agent in the table were as follows:

Binder (PVA), polyvinyl alcohol Mowiol 28-99 (Kuraray);

Binder (latex), styrene-butadiene latex L-1537 (Asahi Chemical);

Crosslinking agent, glyoxal Cartabond GHF (Clariant).

Tables 2 and 3 summarize the specifics of the first inorganic particles and the second inorganic particles, respectively, in Table 1. All inorganic particles in Table 2 had an average aspect ratio of at least 5.0, and all inorganic particles in Table 3 had an average aspect ratio of less than 5.0.

TABLE 1

Preparation of Coating Liquids for the Formation of a Backcoat Layer

| | First inorganic particle | | | Second inorganic particle | | | Binders | | Crosslinking agent |
|---|---|---|---|---|---|---|---|---|---|
| Coating liquid | Material | Average diameter (μm) | Content (parts) | Material | Average diameter (μm) | Content (parts) | PVA (parts) | Latex (parts) | Glyoxal (parts) |
| Coating liquid B-1 | Tabular kaolin | 1.0 | 50.0 | Calcium carbonate 1 | 0.3 | 50.0 | 5.0 | 6.0 | 1.0 |
| Coating liquid B-2 | Tabular kaolin | 1.0 | 70.0 | Calcium carbonate 1 | 0.3 | 30.0 | 19.0 | 0.0 | 1.0 |
| Coating liquid B-3 | Tabular kaolin | 1.0 | 30.0 | Calcium carbonate 1 | 0.3 | 70.0 | 5.0 | 6.0 | 1.0 |
| Coating liquid B-4 | Tabular kaolin | 1.0 | 50.0 | Calcium carbonate 2 | 0.9 | 50.0 | 15.0 | 0.0 | 1.0 |
| Coating liquid B-5 | Tabular talc 1 | 8.0 | 50.0 | Calcium carbonate 1 | 0.3 | 50.0 | 5.0 | 6.0 | 1.0 |
| Coating liquid B-6 | Tabular kaolin | 1.0 | 30.0 | Calcium carbonate 1 | 0.3 | 70.0 | 6.0 | 0.0 | 1.0 |
| Coating liquid B-7 | Tabular kaolin | 1.0 | 30.0 | Calcium carbonate 1 | 0.3 | 70.0 | 5.0 | 0.0 | 1.0 |
| Coating liquid B-8 | Tabular kaolin | 1.0 | 50.0 | Calcium carbonate 1 | 0.3 | 50.0 | 19.0 | 0.0 | 1.0 |
| Coating liquid B-9 | Tabular kaolin | 1.0 | 50.0 | Calcium carbonate 1 | 0.3 | 50.0 | 20.0 | 0.0 | 1.0 |
| Coating liquid B-10 | Tabular kaolin | 1.0 | 50.0 | Calcium carbonate 1 | 0.3 | 50.0 | 11.0 | 0.0 | 1.0 |
| Coating liquid B-11 | Tabular mica | 2.7 | 50.0 | Calcium carbonate 1 | 0.3 | 50.0 | 5.0 | 6.0 | 1.0 |
| Coating liquid B-12 | Tabular calcium carbonate | 0.7 | 50.0 | Calcium carbonate 1 | 0.3 | 50.0 | 5.0 | 6.0 | 1.0 |
| Coating liquid B-13 | Tabular zeolite | 2.0-3.0 | 50.0 | Calcium carbonate 1 | 0.3 | 50.0 | 5.0 | 6.0 | 1.0 |
| Coating liquid B-14 | Tabular kaolin | 1.0 | 50.0 | Kaolin | 0.6 | 50.0 | 5.0 | 6.0 | 1.0 |
| Coating liquid B-15 | Tabular kaolin | 1.0 | 50.0 | Titanium oxide | 0.3 | 50.0 | 5.0 | 6.0 | 1.0 |
| Coating liquid B-16 | Tabular kaolin | 1.0 | 100.0 | — | — | 0 | 19.0 | 0 | 1.0 |
| Coating liquid B-17 | Tabular kaolin | 1.0 | 72.0 | Calcium carbonate 1 | 0.3 | 28.0 | 19.0 | 0 | 1.0 |
| Coating liquid B-18 | Tabular kaolin | 1.0 | 28.0 | Calcium carbonate 1 | 0.3 | 72.0 | 5.0 | 6.0 | 1.0 |
| Coating liquid B-19 | — | — | 0 | Calcium carbonate 1 | 0.3 | 100.0 | 5.0 | 6.0 | 1.0 |
| Coating liquid B-20 | Tabular kaolin | 1.0 | 50.0 | Colloidal silica | 0.09 | 50.0 | 5.0 | 6.0 | 1.0 |
| Coating liquid B-21 | Tabular kaolin | 1.0 | 50.0 | Calcium carbonate 3 | 1.0 | 50.0 | 5.0 | 6.0 | 1.0 |
| Coating liquid B-22 | Tabular alumina | <0.2 | 50.0 | Calcium carbonate 1 | 0.3 | 50.0 | 5.0 | 6.0 | 1.0 |
| Coating liquid B-23 | Tabular talc 2 | 11.0 | 50.0 | Calcium carbonate 1 | 0.3 | 50.0 | 5.0 | 6.0 | 1.0 |

TABLE 2

First Inorganic Particles

| Pigment | Trade name | Manufacturer | Average diameter (μm) |
|---|---|---|---|
| Tabular kaolin | Hydragloss 90 | KaMin | 1.0 |
| Tabular talc 1 | LMK-100 | Fuji Talc | 8.0 |
| Tabular mica | MK-100 | Co-op Chemical | 2.7 |
| Tabular calcium carbonate | BCC-07 | Chichibu Lime Industry | 0.7 |
| Tabular zeolite | TMC | ZEEKLITE | 2.0 to 3.0 |
| Tabular alumina | — | — | <0.2 |
| Tabular talc 2 | LMP-100 | Fuji Talc | 11.0 |

TABLE 3

Second Inorganic Particles

| Pigment | Trade name | Manufacturer | Average diameter (μm) |
|---|---|---|---|
| Calcium carbonate 1 | Opacarb A40 | Specialty Minerals | 0.3 |
| Calcium carbonate 2 | SOFTON 2600 | Shiraishi Kogyo | 0.9 |
| Kaolin | ASP600 | Hayashi-Kasei | 0.6 |
| Titanium oxide | KA10 | Titan Kogyo | 0.3 |

TABLE 3-continued

| Second Inorganic Particles | | | |
|---|---|---|---|
| Pigment | Trade name | Manufacturer | Average diameter (μm) |
| Colloidal silica | ZL | Nissan Chemical | 0.09 |
| Calcium carbonate 3 | SOFTON 2200 | Shiraishi Kogyo | 1.0 |

Preparation of Coating Liquids for the Formation of an Ink-Receiving Layer

Preparation of Ink-Receiving-Layer-Forming Coating Liquid A

Alumina hydrate Disperal HP14 (Sasol) was added to purified water to make the solid concentration 30% by mass. Then methanesulfonic acid was added to make the ratio of methanesulfonic acid to alumina hydrate 1.5 parts by mass to 100 parts by mass, and the resulting mixture was stirred. The mixture was then diluted with such an amount of purified water that the solid concentration of the alumina hydrate would be 27% by mass, yielding colloidal sol A. Separately, polyvinyl alcohol PVA 235 (degree of polymerization, 3500; degree of saponification, 88%) (Kuraray) was dissolved in ion-exchanged water to form an aqueous solution of PVA having a solid content of 8.0% by mass. Then this aqueous solution of PVA was mixed into colloidal sol A to make the solid PVA content 11% by mass based on the solid alumina hydrate content. Then a 3.0% by mass aqueous solution of orthoboric acid was added to make the solid boric acid content 1.0% by mass based on the solid alumina hydrate content, yielding ink-receiving-layer-forming coating liquid A.

Preparation of Ink-Receiving-Layer Coating Liquid B

One hundred parts of fumed silica A300 (Nippon Aerosil) and 4 parts of cationized polymer SHALLOL DC902P (Daiichi Kogyo Seiyaku) were dispersed in purified water to make the concentration 18% by mass and then further dispersed using a high-pressure homogenizer, yielding colloidal sol B. Then the aforementioned aqueous solution of PVA was mixed into colloidal sol B to make the solid PVA content 22% by mass based on the solid fumed silica content. Then a 3.0% by mass aqueous solution of orthoboric acid was added to make the solid boric acid content 3.5% by mass based on the solid silica content, yielding ink-receiving-layer-forming coating liquid B.

Preparation of Ink-Receiving-Layer-Forming Coating Liquid C

Colloidal sol A and colloidal sol B were mixed to make the ratio of the solid mass of alumina hydrate to that of fumed silica 95:5, and the aforementioned aqueous solution of PVA was added to make the solid PVA content 11% by mass based on the total solid content of alumina hydrate and fumed silica. Then a 3.0% by mass aqueous solution of orthoboric acid was added to make the solid boric acid content 1.0% by mass based on the total solid content of alumina hydrate and fumed silica, yielding ink-receiving-layer-forming coating liquid C.

Preparation of Recording Media 1 to 23

Preparation of Recording Media

Each of the coating liquids for the formation of a backcoat layer was applied to the side of the substrate opposite the undercoat layer using a curtain coater and the applied liquid was dried. The amount of the coating liquid was such that the dry weight would be 20 g/m$^2$. Then ink-receiving-layer-forming coating liquids B and C were simultaneously applied to the side of the substrate having the undercoat layer using a curtain coater. The amount of coating liquid B was such that the dry weight would be 5 g/m$^2$, and the amount of coating liquid C was such that the dry weight would be 15 g/m$^2$. The applied liquids were then dried at 60° C. Then gloss was applied to the surface of the ink-receiving layer using a cast coater in a wet process to complete a recording medium. Table 4 summarizes the name of each recording medium and the kind of the coating liquid used to form a backcoat layer.

Preparation of Recording Medium 24

The coating liquid for the formation of a backcoat layer was applied to the side of the substrate opposite the undercoat layer using a curtain coater and the applied liquid was dried. The amount of the coating liquid was such that the dry weight would be 20 g/m$^2$. Then ink-receiving-layer-forming coating liquids B and A were simultaneously applied to the side of the substrate having the undercoat layer using a curtain coater. The amount of coating liquid B was such that the dry weight would be 5 g/m$^2$, and the amount of coating liquid A was such that the dry weight would be 15 g/m$^2$. The applied liquids were then dried at 60° C. Then gloss was applied to the surface of the ink-receiving layer using a cast coater in a wet process to complete recording medium 24.

Evaluation

In this example, grades A to C in the evaluation criteria in "Album releasability of recording media" and "Protection against damage on conveyance" below mean that the recording medium was acceptable in terms of the specific assessment, and D and E mean that the recording medium was unacceptable.

Album Releasability of Recording Media

The album releasability of each recording medium was tested in accordance with the following procedure. A 2.5 cm×8.0 cm specimen cut out of the recording medium was placed on an adhesive surface of an NF-20L photo album (Fujifilm) an album with adhesive pages, with its back (the surface having a backcoat layer) down and then rubbed with a forefinger to adhere. Then the specimen was manually rubbed under the clear plastic sheet on the page of the album with no air allowed in. After 1 hour with the album closed, the plastic sheet was removed, and the specimen was removed. The back of the removed specimen was observed and evaluated using the following criteria. The results of the evaluation are summarized in Table 4.

A: Removed smoothly without adhesion.
B: Removed with weak adhesion.
C: Less than ⅕ the area of the specimen adhered.
D: ⅕ to less than ½ the area of the specimen adhered.
E: At least ½ the area of the specimen adhered.

Protection Against Damage on Conveyance

Ten sheets of each recording medium were loaded into a PIXUS 990i ink jet recording device (CANON KABUSHIKI KAISHA) and sequentially recorded with an image at a duty of 100% using a black ink. The obtained images were visually inspected for damage on conveyance. The criteria for evaluation were as follows. The results of the evaluation are summarized in Table 4.

A: No damage on conveyance.
B: Slight but negligible hazy damage on conveyance.
C: Slight but negligible streaky damage on conveyance.
D: Evident hazy damage on conveyance.
E: Evident streaky damage on conveyance.

Opacity of Recording Media

The opacity of the obtained recording media was measured in accordance with ISO 2471: 2008 using Technibrite Micro TB-1C (Technidyne). The criteria for evaluation were as follows. The results of the evaluation are summarized in Table 4.

A: Opacity was 98% or more.
B: Opacity was 97% to less than 98%.
C: Opacity was 96% to less than 97%.
D: Opacity was 94% to less than 96%.
E: Opacity was 92% to less than 94%.

TABLE 4

| Evaluation Results | | | | | |
|---|---|---|---|---|---|
| | | | Results | | |
| Example | Recording medium | Coating liquid used to form backcoat layer | Album releasability | Protection against damage on conveyance | Opacity |
| Example 1 | Recording medium 1 | Coating liquid B-1 | A | A | A |
| Example 2 | Recording medium 2 | Coating liquid B-2 | C | B | C |
| Example 3 | Recording medium 3 | Coating liquid B-3 | B | B | A |
| Example 4 | Recording medium 4 | Coating liquid B-4 | B | B | A |
| Example 5 | Recording medium 5 | Coating liquid B-5 | B | A | A |
| Example 6 | Recording medium 6 | Coating liquid B-6 | B | B | A |
| Example 7 | Recording medium 7 | Coating liquid B-7 | C | C | A |
| Example 8 | Recording medium 8 | Coating liquid B-8 | B | B | A |
| Example 9 | Recording medium 9 | Coating liquid B-9 | C | C | A |
| Example 10 | Recording medium 10 | Coating liquid B-10 | A | B | A |
| Example 11 | Recording medium 11 | Coating liquid B-11 | A | B | A |
| Example 12 | Recording medium 12 | Coating liquid B-12 | A | B | A |
| Example 13 | Recording medium 13 | Coating liquid B-13 | A | C | A |
| Example 14 | Recording medium 14 | Coating liquid B-14 | A | A | C |
| Example 15 | Recording medium 15 | Coating liquid B-15 | A | A | A |
| Example 16 | Recording medium 24 | Coating liquid B-1 | A | B | A |
| Comparative Example 1 | Recording medium 16 | Coating liquid B-16 | E | B | E |
| Comparative Example 2 | Recording medium 17 | Coating liquid B-17 | D | B | D |
| Comparative Example 3 | Recording medium 18 | Coating liquid B-18 | D | D | B |
| Comparative Example 4 | Recording medium 19 | Coating liquid B-19 | E | E | C |
| Comparative Example 5 | Recording medium 20 | Coating liquid B-20 | D | A | D |
| Comparative Example 6 | Recording medium 21 | Coating liquid B-21 | D | D | A |
| Comparative Example 7 | Recording medium 22 | Coating liquid B-22 | E | B | C |
| Comparative Example 8 | Recording medium 23 | Coating liquid B-23 | D | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-220412 filed Oct. 23, 2013, which is hereby incorporated by reference herein in its entirety.

What is claimed is:

1. A recording medium comprising a backcoat layer, a substrate, and an ink-receiving layer in this order, wherein:

the backcoat layer comprises a first inorganic particle, a second inorganic particle, and a binder, the first inorganic particle has an average aspect ratio, which is a ratio of an average diameter to an average thickness, of 5 or more and an average diameter of 0.2 μm or more and 10.0 μm or less, the second inorganic particle has an average aspect ratio, which is a ratio of an average diameter to an average thickness, of less than 5 and an average diameter of 0.1 μm or more and 0.9 μm or less, and a mass ratio of a content of the first inorganic particle to a content of the second inorganic particle in the backcoat layer is 30/70 or more and 70/30 or less.

2. The recording medium according to claim 1, wherein in the backcoat layer, a content of the binder is 6% by mass or more and 19% by mass or less of a total content of the inorganic particles.

3. The recording medium according to claim 1, wherein:

the ink-receiving layer has a first ink-receiving layer and a second ink-receiving layer, the first ink-receiving layer being closer to the substrate than the second ink-receiving layer is, the first ink-receiving layer comprises fumed silica, and the second ink-receiving layer comprises alumina hydrate and fumed silica.

4. The recording medium according to claim 3, wherein a mass ratio of a content of the alumina hydrate to a content of the fumed silica in the second ink-receiving layer is 70/30 or more.

5. The recording medium according to claim 3, wherein the first ink-receiving layer has a thickness of 10 μm or less, and the second ink-receiving layer has a thickness of 3 μm or more and 20 μm or less.

6. A recording medium comprising a backcoat layer, a substrate, and an ink-receiving layer in this order, wherein:

the backcoat layer comprises a first inorganic particle having an average diameter of 0.2 μm or more and 10.0 μm or less, a second inorganic particle having an average particle diameter of 0.1 μm or more and 0.9 μm or less, and a binder, the first inorganic particle includes at least one selected from tabular kaolin, tabular calcium carbonate, tabular mica, and tabular talc, the second inorganic particle includes at least one selected from elongated calcium carbonate and titanium oxide, and a mass ratio of a content of the first inorganic particle to a content of the second inorganic particle in the backcoat layer is 30/70 or more and 70/30 or less.

* * * * *